United States Patent [19]

Hastings

[11] 4,191,190

[45] Mar. 4, 1980

[54] EARLOBE PIERCING INSTRUMENT HOLDER

[76] Inventor: John A. Hastings, 31 Main St., Bass River, Mass. 02664

[21] Appl. No.: 797,808

[22] Filed: May 12, 1977

[51] Int. Cl.[2] ..... A61B 17/00

[52] U.S. Cl. ..... 128/330

[58] Field of Search ..... 128/330, 329 R; 227/144

[56] References Cited

U.S. PATENT DOCUMENTS

| | | | |
|---|---|---|---|
| 3,901,243 | 8/1975 | Read | 128/329 R |
| 4,009,718 | 3/1977 | Hastings | 128/330 |
| 4,030,507 | 6/1977 | Mann | 128/330 |

*Primary Examiner*—Robert W. Michell
*Assistant Examiner*—Michael H. Thaler
*Attorney, Agent, or Firm*—Wolf, Greenfield & Sacks

[57] ABSTRACT

The holder is designed for use with earlobe piercing instruments such as that disclosed in co-pending application Ser. No. 759,384. The holder consists of a pair of jaws connected by a flexible bight. Each jaw has a recess at its free end to receive a portion of an ear piercing instrument. In use, an instrument is inserted between the jaws of the holder. The holder and instrument are aligned with an earlobe between the pin and locknut carried by the instrument. As the jaws of the holder are squeezed together, the piercing pin and a receiving locknut are moved toward one another. Further pressure on the legs of the holder releases the piercing pin, suddenly projecting it through the earlobe into engagement with the locknut. As pressure is relaxed, the resilience of the holder's bight moves the jaws apart, leaving the pin and nut secured to the ear and the ear piercing instrument free of the holder for separation from the pin and locknut.

3 Claims, 7 Drawing Figures

EARLOBE PIERCING INSTRUMENT HOLDER

BACKGROUND OF THE INVENTION

This invention is designed to facilitate the use of disposable piercing instruments such as the instrument disclosed in Ser. No. 759,384. Heretofore, disposable ear piercers of the type described in this application are occasionally improperly used when a closing force is not applied in alignment with the plunger. This holder eliminates such occasional misuse by assuring that a closing force on the instrument will always be applied in alignment with the plunger. This holder also permits a surer grip on the instrument. The holder is also designed to facilitate use of ear piercers by individuals with large hands or limited dexterity.

SUMMARY OF THE INVENTION

The invention includes a pair of jaws movable toward one another, connected by a flexible, integrally formed bight. Each jaw has a recess near its tip which engages a portion of the piercing instrument under slight compression. A long flange is provided for strengthening of the jaw which engages the plunger portion of the instrument and indicates the preferred orientation of the instrument. The portion of the instrument supporting the locknut is engaged by the other jaw. In use, the holder with an instrument secured under slight compression between its jaws is articulated under slight pressure to position the piercing pin on the surface of an earlobe. On application of further pressure on the jaws of the holder, the pin is suddenly released from the instrument and projected through the earlobe into the aligned locknut. The resilience of the holder bight then opens the jaws of the holder as pressure is reduced, separating the holder from the instrument. The disposable instrument may then be removed from the earlobe, leaving the pin and nut on the earlobe.

It is among the objects of the invention to facilitate the use of pre-sterilized, disposable earlobe piercing instruments.

Another object of the invention is to minimize handling of sterile earlobe piercing instruments.

Another object of the invention is to permit a greater force to be concentrated on the piercing pin.

Another object of the invention is to provide an instrument which allows greater force on the piercing instrument by using the whole hand.

Another object of this invention is to provide an instrument which will automatically align the ear piercing pin and nut and apply pressure to the instrument in exactly the right direction. Forces are applied along the axis of the plunger, the ear stud and nut at the time of closing.

A further object of the invention is to provide a holder which will give the user a feeling of security in using an instrument of increased size or bulk.

DESCRIPTION OF THE DRAWINGS

The foregoing and other objects and advantages of the invention will be understood more fully from the following detailed description thereof, with reference to the accompanying drawings, wherein.

DETAILED DESCRIPTION OF THE INVENTION

Figure 1:
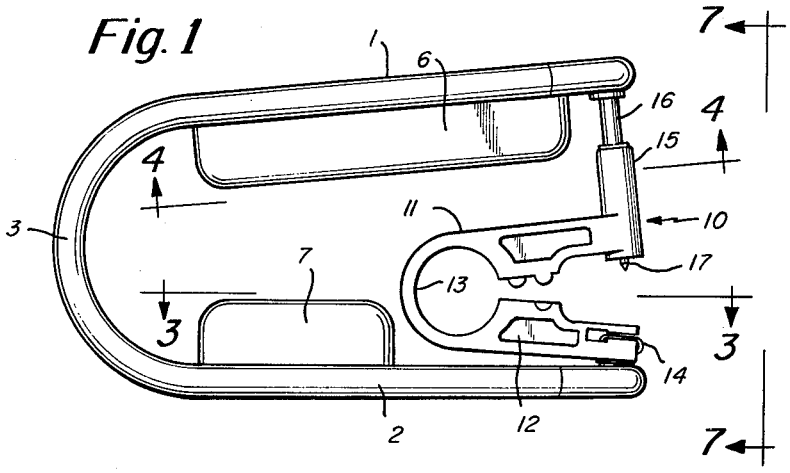
FIG. 1 is a side elevation of the piercing instrument and holder in an open position.
Figure 4:
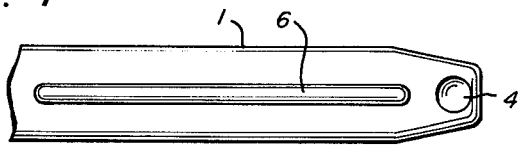
FIG. 4 is a sectional illustration of the upper jaw as seen along the line 4—4 of FIG. 1.
Figure 5:
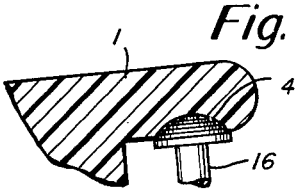
FIG. 5 is an enlarged elevational view in partial cross-section of the recess in the upper jaw and the plunger it engages.
Figure 3:
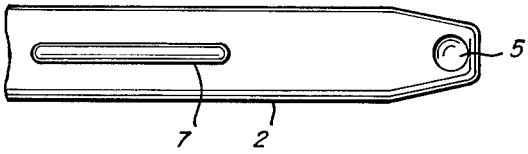
FIG. 3 is a sectional illustration of the lower jaw as seen along the line 3—3 of FIG. 1.
Figure 6:
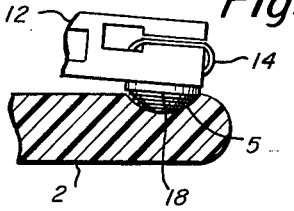
FIG. 6 is an enlarged elevational view in partial cross-section of the recess in the lower jaw and the knob which it engages below the locknut-holding means.
Figure 2:
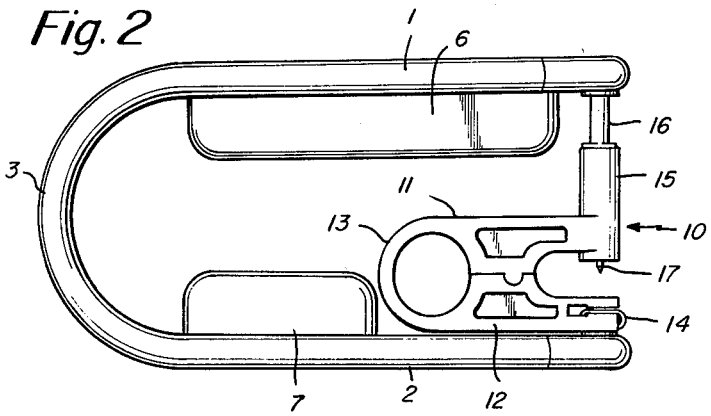
FIG. 2 is a side elevation of the piercing instrument and holder in a closed position.
Figure 7:
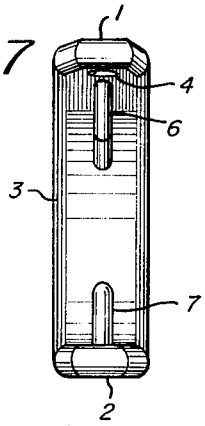
FIG. 7 is an elevational view of the holder in an open position with the instrument removed, taken along the line 7—7 of FIG. 1.

Referring to the drawings there is illustrated in FIG. 1 a holder having jaws 1 and 2 interconnected by a flexible integrally formed bight 3. The jaw 1 is formed with recess 4 at its free end and the jaw 2 is provided with a recess 5 (FIG. 6), also at its free end. The recesses 4 and 5 are shaped and positioned to be aligned when the jaws 1 and 2 are in a closed position, as illustrated in FIG. 2. The inner surface of jaw 1 is also provided with a flange 6 that is centrally located and that extends from just short of the free or foward end of the jaw 1 to a position close to the bight 3. The flange 6 extends inwardly approximately onequarter of the distance of the space between the jaws 1 and 2 when in the closed position, as illustrated in FIG. 2.

The flange 7 formed on the inner surface of jaw 2 extends from near the bight 3 to a position approximately half way along the length of the jaw 2. This flange has a height which is essentially equal to the height of flange 6.

The holder is made of a suitable plastic that will permit flexing of the holder along the bight so as to move the holder from the position shown in FIG. 1 to the position shown in FIG. 2 under hand pressure. The plastic selected should be resilient. Suitable polystyrene or polyethylene plastics may be used.

The earlobe piercing instrument generally illustrated at 10 is best illustrated in my co-pending application Ser. No. 759,384. The ear-piercing instrument illustrated in my co-pending application, illustrative of the type of ear piercing device for which the invention here in described is designed, includes a pair of jaws 11 and 12 connected by an integral bight 13. The free end of jaw 12 is provided with slot means designed to hold a lockout 14 of the type normally used in ear piercing systems. The other jaw 11 is provided with means 15 for supporting plunger 16. Plunger 16 in turn engages the head of an ear piercing pin with the tip 17 projecting from the means 15. In use, the operator normally places an earlobe between the point 17 of the pin and the locknut 14. The piercing instrument is then squeezed by applying pressure to the end of the plunger 16 and the outer surface of the end of the jaw 12. This causes the instrument to compress to the position illustrated in FIG. 2. Upon application of further pressure the pin is suddenly released to pierce the earlobe and engage the locknut. Pressure on the instrument is released allowing the jaws to separate. The instrument is then slid from engagement with the now interengaged pin and locknut.

In the present invention, the instrument generally illustrated at 10 is positioned under slight compression between jaws 1 and 2 of the holder with the free end of plunger 16 engaged in recess 4 and a boss 18 integrally formed on the free end of jaw 12 engaged in recess 5. In this arrangement, the instrument 10 and holder assume the position generally illustrated in FIG. 1. In preferred use, the instrument should be inserted as illustrated in FIG. 1 which is encouraged by the size and location of flange 6. The application of about 1½ pounds force closes the holder and instrument to the position shown in FIG. 2. Increasing the force to about ten pounds results in the sudden release of the pin from its initial position in the instrument. The tip 17 of the pin then pierces the earlobe and engages the locknut 14. Removal of the force from the holder allows the jaws of the holder to return to their original position. But, since the plunger 16 of the instrument remains depressed in the instrument the overall distance between the outer extremities of jaw 12 and plunger 16 is shorter than the distance between the ends of jaws 1 and 2. Thus the holder is automatically disengaged from the instrument.

The size of the holder may vary, depending upon the specific type of ear piercing instrument used. However, in a preferred embodiment, the holder should be sized with jaws sufficiently long to fit comfortably in one's hand. The drawings herewith submitted are in the preferred embodiment drawn to full scale.

Having now described my invention, I claim:

1. In combination, an earlobe piercing instrument and a holder for said instrument, said earlobe piercing instrument including a plunger adapted to engage the head of an earlobe piercing pin and means for supporting a locknut adapted to receive the pointed end of said pin after it has been projected through an earlobe, said holder comprising means for engaging said plunger and means for engaging said locknut supporting means for relative movement toward one another, said means for engaging said plunger and said means for engaging said locknut supporting means being positioned at the outermost ends of said plunger and said locknut supporting means, respectively, and means commonly supporting said plunger engaging means and said lockout supporting means, wherein said piercing instrument has a pair of jaws and means resiliently holding said jaws apart, said means resiliently holding said jaws apart also in part providing means for securing said instrument to said means commonly supporting said plunger engaging means and said locknut supporting means.

2. In combination, an earlobe piercing instrument and a holder for said instrument, said earlobe piercing instrument including a plunger adapted to engage the head of an earlobe piercing pin and means for supporting a locknut adapted to receive the pointed end of said pin after it has been projected through an earlobe, said holder comprising means for engaging said plunger and means for engaging said locknut supporting means for relative movement toward one another, said means for engaging said plunger and said means for engaging said locknut supporting means being positioned at the outermost ends of said plunger and said locknut supporting means, respectively, and means commonly supporting said plunger engaging means and said locknut supporting means, wherein said common supporting means comprises a pair of jaws including a flange on the inner sides of each of said jaws, with the flange on one jaw longer than the flange on the other, said common supporting means having means on their inner surface for engaging said plunger and said lockout supporting means, and a resilient bight interconnecting and integrally formed with said jaws.

3. In combination, an earlobe piercing instrument and a holder for said instrument, said earlobe piercing instrument including a plunger adapted to engage the head of an earlobe piercing pin and means for supporting a locknut adapted to receive the pointed end of said pin after it has been projected through an earlobe, said holder comprising means for engaging said plunger and means for engaging said locknut supporting means for relative movement toward one another, said means for engaging said plunger and said means for engaging said locknut supporting means being positioned at the outermost ends of said plunger and said locknut supporting means, respectively, and means commonly supporting said plunger engaging means and said locknut supporting means, including means for automatically disengaging said instrument from said holder after said pin is projected through an earlobe, so that said instrument is disengaged from said holder while said plunger is in a position formerly occupied by said pin prior to insertion into an earlobe.

* * * * *